US005988935A

United States Patent [19]

Dillingham

[11] Patent Number: 5,988,935

[45] Date of Patent: Nov. 23, 1999

[54] ASPHALT REPAIR APPARATUS WITH DRY, RADIANT HEAT SOURCE

[75] Inventor: Harold W. Dillingham, Jacksonville, Tex.

[73] Assignee: H.D. Industries, Inc., Jacksonville, Tex.

[21] Appl. No.: 09/144,176

[22] Filed: Aug. 31, 1998

[51] Int. Cl.[6] ..... E01C 23/00

[52] U.S. Cl. ..... 404/79; 404/75; 404/90; 404/101; 404/108; 404/111

[58] Field of Search ..... 104/77, 79, 80, 104/95, 101, 108, 110, 111, 71, 91

[56] References Cited

U.S. PATENT DOCUMENTS

| | | | |
|---|---|---|---|
| 3,100,425 | 8/1963 | Cartwright . | |
| 3,217,620 | 11/1965 | Mindrum et al. . | |
| 3,279,337 | 10/1966 | Weaver . | |
| 4,256,414 | 3/1981 | Milligan | 404/79 |
| 4,944,632 | 7/1990 | Dillingham | 404/111 |
| 5,006,012 | 4/1991 | Sterner | 404/107 |
| 5,139,362 | 8/1992 | Richter et al. | 404/95 |
| 5,232,306 | 8/1993 | Sterner | 404/107 |
| 5,263,790 | 11/1993 | Bickley et al. | 404/107 |
| 5,354,145 | 10/1994 | Sterner | 404/75 |
| 5,419,654 | 5/1995 | Kleiger | 404/101 |
| 5,607,254 | 3/1997 | Grembowicz et al. | 404/77 |
| 5,752,782 | 5/1998 | Hulicsko | 404/103 |
| 5,765,963 | 6/1998 | Roberts | 404/92 |

*Primary Examiner*—Thomas B. Will
*Assistant Examiner*—Raymond W Addle
*Attorney, Agent, or Firm*—Charles D. Gunter, Jr.

[57] ABSTRACT

A portable device is shown for transporting asphalt repair materials for use in repairing potholes in asphalt pavements. The device has a body with a hopper compartment for transporting and dispensing asphalt mix materials. A dry, radiant heat source is located below the hopper compartment and heats the asphalt mix. Tack oils are held and dispensed from a separate tack oil tank.

10 Claims, 5 Drawing Sheets

ASPHALT REPAIR APPARATUS WITH DRY, RADIANT HEAT SOURCE

BACKGROUND OF THE INVENTION

1. Field of the Invention

The present invention relates generally to truck and/or trailer mounted portable devices for dispensing pavement repair materials and, specifically, to such a portable device for dispensing repair materials for asphalt pavements.

2. Description of the Prior Art

In the past, as many as three vehicles were sometimes needed to repair openings and potholes in asphalt, concrete and other roadway surfaces. One vehicle provided an air compressor for use with various pneumatic repair tools which were used to dress the hole, crack or cavity to be filled. Another vehicle contained liquid asphalt tack material which would be sprayed into the dressed cavity, and a third vehicle would deliver asphalt mix material to the cavity. The asphalt would then be packed, compacted and leveled by hand to complete the repair.

U.S. Pat. No. 4,196,827, issued Apr. 8, 1980, entitled "Portable Machine For Transporting Heated Asphalt Products For Use In Repair Asphalt Pavement" shows a portable machine which was designed to incorporate all phases of the pavement repair into one mobile unit. The machine has a hopper for transporting asphalt mix, and a reservoir below the hopper having a heat source. The reservoir contained liquid asphalt tack material. The heat source is used to heat the liquid tack material, and the tack material is used to heat the asphalt mix in the hopper by heat transfer. Asphalt tack material is also dispensed from the tack material tank by means of spray equipment connected to a discharge valve on the rear of the truck.

In spite of being less expensive to operate in terms of material and labor, the previously described device possessed several different disadvantages. For example, the liquid asphalt tank carried on the unit was suitable for road oils and cutbacks but was not well suited for use with asphaltic cements. Also, in the case of the device described in the '827 patent, the liquid asphalt tank was not suited for use with asphalt emulsions, because the volatile contents of the emulsions would be driven off and dry out the materials.

U.S. Pat. No. 4,944,632, issued Jul. 31, 1990, and assigned to the assignee of the present invention showed a portable unit with a separate tack oil tank which was provided with its own heat source and which was designed to prevent phase separation of the tack oil materials to overcome some of the deficiencies of the prior art devices. This tank could be used successfully with both emulsions and asphalt cutback oils.

Both of the prior art devices utilized a liquid heat transfer medium to heat the asphalt hopper of the device and maintain the asphalt mix materials therein in a workable state. While a liquid heat transfer medium has been used successfully for many years to heat the asphalt hopper, there are disadvantages associated with the use of a liquid medium. Many of these disadvantages relate to the release of volatile components of the medium as it is repeatedly heated during use. The liquid medium must also be maintained and/or replaced at regular maintenance intervals.

Accordingly, it is an object of the present invention to replace the liquid heat transfer medium used in the prior art to heat the hopper compartment of an asphalt repair apparatus with a dry, radiant heat source which does not require refill and which does not emit volatile organic emissions to the atmosphere.

Another object of the invention is to provide such a dry, radiant heat source for an asphalt repair apparatus which heat source safely and effectively heats the asphalt repair materials without hardening, burning or charring such materials.

Another object of the invention is to provide such an apparatus which is simple in design and economical to manufacture.

SUMMARY OF THE INVENTION

The portable apparatus of the invention is used to transport heated pavement repair materials for use in repairing roadways and other traffic bearing surfaces. The device includes a body adapted to be mounted on a portable base for transporting the body to a repair site. The body has a hopper compartment with a V-shaped bottom wall for transporting asphalt mix material and a generally V-shaped heating chamber located below the hopper compartment. The V-shaped bottom wall of the hopper compartment defines an upper extent of the heating chamber. A screw conveyor is mounted in the bottom of the hopper compartment for dispensing asphalt mix materials therefrom. An agitator, such as a paddle shaft, is located above the screw conveyor in the hopper compartment for agitating the hopper materials. A dry heat means is associated with the heating chamber for heating the chamber and for transferring heat to the hopper compartment through the hopper bottom wall to maintain the asphalt mix materials in a workable state.

Preferably, the V-shaped bottom wall of the hopper compartment forms an upper, uninsulated common wall with the heating chamber. The heating chamber also has oppositely extending, insulated bottom wall portions. In a preferred embodiment of the invention, the dry heat means comprises a pair of oppositely arranged retort tubes located within the heating chamber on either side of the V-shaped bottom wall of the hopper. The retort tubes are heated by a thermostatically controlled gas burner for supplying dry, radiant heat to the bottom wall of the hopper. Each retort tube forms a single pass loop which has a burner installed at one extent thereof and which communicates with an exhaust stack at the opposite extent thereof. In a preferred arrangement, each retort tube is provided in the shape of an inclined U arranged in a plane which is generally parallel to a selected one of the oppositely extending, insulated bottom wall portions of the heating chamber. Each retort tube has a pair of outlets to the exterior of the tank, one of the outlets having the burner mounted therein and the other of the outlets being connected to the exhaust stack.

Additional objects, features and advantages will be apparent in the written description which follows.

DETAILED DESCRIPTION OF THE INVENTION

Figure 1:
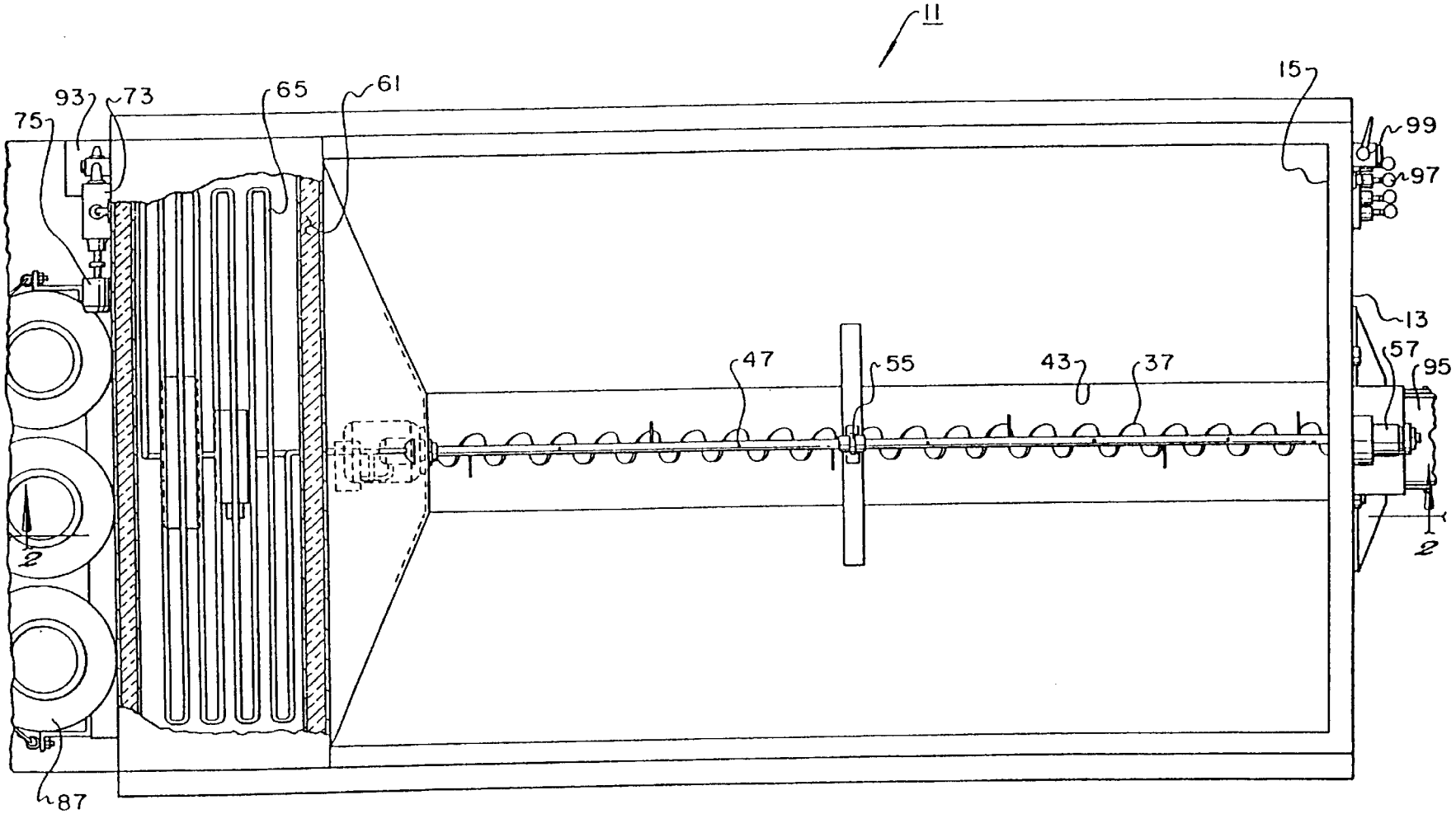
Fig. 1 (PRIOR ART)
FIG. 1 is a top view of a prior art portable device for transporting asphalt repair materials.

The advantages of present invention can best be understood with reference to Applicant's prior art device which utilized a liquid heat transfer medium. Accordingly, turning to FIG. 1, there is shown Applicant's commercially available design designated generally as 11. The device 11 includes a body 13 which is generally rectangular in shape and which is adapted to be mounted upon the bed of a truck, or upon a trailer which would be towed by a vehicle. The truck or trailer would serve as a portable base for transporting the body 13 to a repair site for repairing a pothole in an asphalt pavement.

Figure 2:
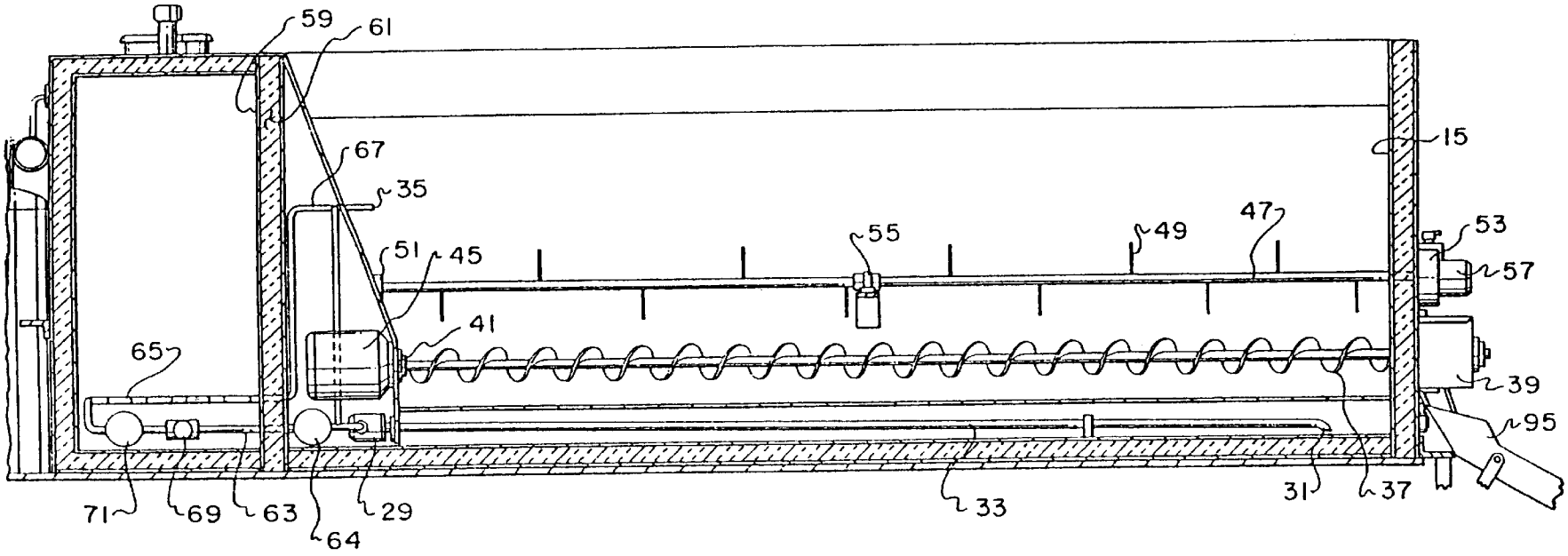
Fig. 2 (PRIOR ART)
FIG. 2 is a side, partial cross-sectional view of the device of FIG. 1 taken along lines 2—2 in FIG. 1.
Figure 3:
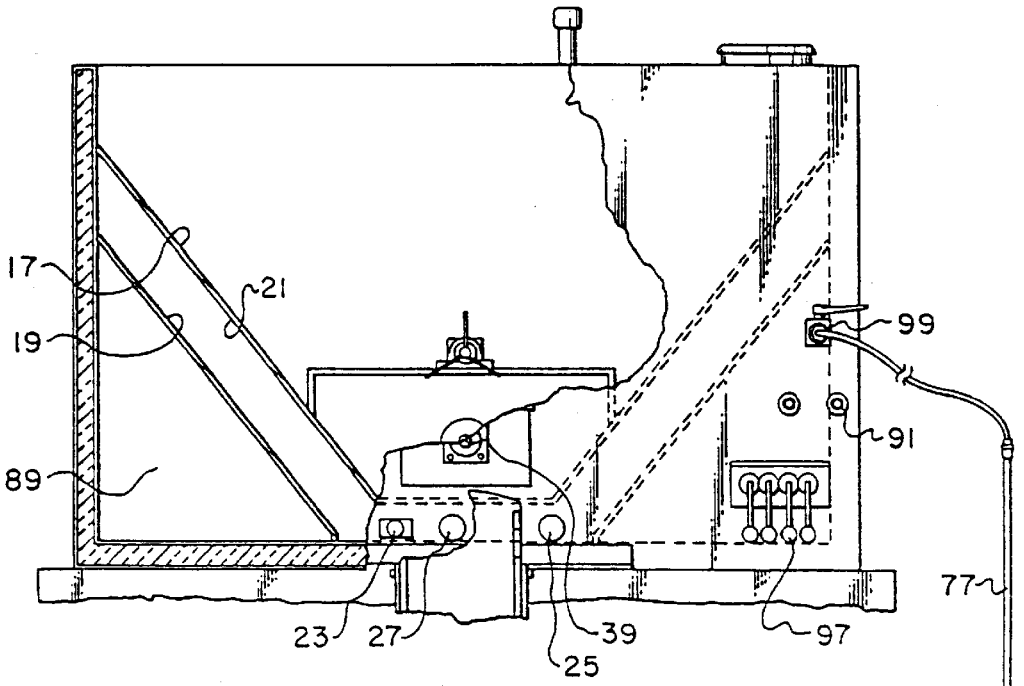
Fig. 3 (PRIOR ART)
FIG. 3 is an end view of one end of the asphalt dispensing device of FIG. 1.

As best seen in FIG. 2, the body has a hopper compartment 15 with a V-shaped bottom wall 17 (FIG. 3) for transporting asphalt mix materials. In this discussion, "asphalt mix" materials will be taken to mean pre-mix or aggregate hot or cold mix asphalt and asphalt aggregate. The term "tack oil" will be taken to mean asphaltic cements, liquid asphalts, and asphalt emulsions of the type carried in a separate tack oil tank, as will be described.

The top of the hopper compartment 15 is open, and is covered with an insulated tarp during use. A heat transfer oil tank 19 (FIG. 3), which is also V-shaped, is located immediately below the bottom wall 17 of the hopper compartment 15 in the prior art device. The heat transfer oil tank 19 includes a top wall 21 which is contiguous with the bottom wall 17 of the hopper compartment 15. The heat transfer oil tank 19 is heated by a retort tube propane burner 23. The propane burner has an electronic igniter system and is preferably thermostatically controlled with a built in safety shut-off to prevent overheating. The tank can also be equipped with an electric heating system including two electric heating elements 25, 27 to be used when asphalt mix materials are left in the hopper overnight or over the weekend.

As shown in FIG. 2, an electric heat transfer oil circulating pump 29 causes heat transfer oil to flow through a conduit opening 31 through a circulating conduit 33 in the bottom of the tank 19 and be emptied back into the top of the tank 19 through a conduit opening 35. By heating the heat transfer oil in the tank with either the burner 23 or heating elements 25, 27, and by circulating the oil with the pump 29, the asphalt mix in the hopper compartment 15 can be evenly heated by heat transfer through the bottom wall 17.

The asphalt mix in the hopper compartment 15 is unloaded with a hydraulically driven screw conveyor 37 which is mounted in suitable bearings 39, 41, so as to span an opening (43 in FIG. 1) into the hopper compartment 154. The screw conveyor 37 is driven by a motor 45 which can be driven by a power takeoff mounted directly to the truck transmission. An asphalt agitator shaft 47 (FIG. 2) having paddles 49 is mounted within the hopper compartment 15 by suitable bearings 51, 53, and by a support bracket 55. The agitator shaft 47 is driven by a hydraulic motor 57 which can be driven by the same pump which supplies power to the screw conveyor. The agitator shaft 47 extends the full length of the hopper compartment, and the shaft movement eliminates asphalt sticking or bridging above the screw conveyor 37.

A separate tack oil tank 59 is mounted on the portable base at one end of the hopper compartment 15 for transporting and dispensing tack oils including road oils, cutbacks, asphaltic cements, liquid asphalts and emulsions. The tack oil tank 59 is surrounded by an insulating layer 61 which also separates the tank from the heated asphalt mix in the hopper compartment 15. Circulating means, such as a conduit 63 and on-off valve 64, communicate with the heat transfer oil pump 29 for circulating heat transfer oil between the heat transfer oil tank and the separate tack oil tank 59. The circulating means also includes heat transfer conduits, in this case coils 65 which are located within the separate tank 59 and which communicate by means of a conduit 67 with the conduit opening 35 which empties heat transfer oil back into the top region of the heat transfer oil tank 19. The circulating means is entirely enclosed within the body of the portable device and is thereby insulated from the atmosphere.

The separate tack oil tank 59 has a retort tube type propane burner 69, as well as a thermostatically controlled electric heating element 71 for keeping the tack oil tank 59 warm overnight. These two heating systems are in addition to the heat transfer conduits 65 for circulating heat transfer oil from the tank 19.

Figure 4:
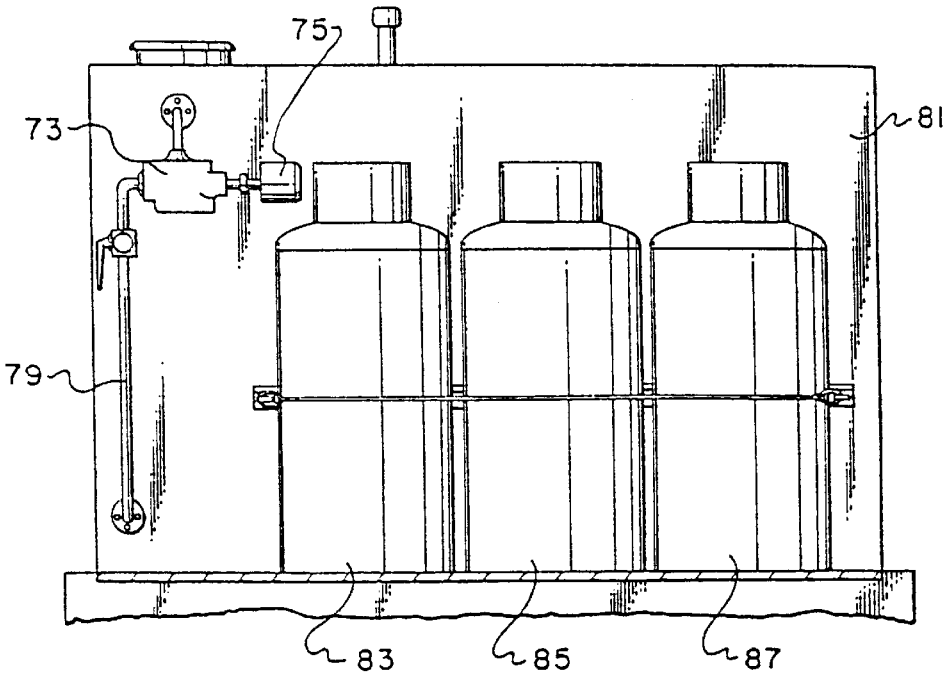
Fig. 4 (PRIOR ART)
FIG. 4 is an end view, showing the opposite end of the device of FIG. 1.

As shown in FIG. 4, the separate tack oil tank 59 is provided with a liquid asphalt pump 73 and pump motor 75 for dispensing tack oils through a hand held wand (77 in FIG. 3) which is connected to the pump 73 by intermediate lines 79.

Located at the front end 81 of the portable device 11 (FIG. 4) are three removable propane bottles 83, 85, 87, which are complete with valves and a regulator for supplying fuel for the propane retort tube burners 23, 69. The dispensing end (89 in FIG. 3) of the portable device 11 also has hydraulic tool lines 91 for a hydraulic jackhammer (not shown) for cutting asphalt and squaring up potholes. The hydraulic tool lines 91 are powered from the hydraulic pump which is driven by the truck transmission. A 15 gallon diesel fuel tank 93 is provided at the left corner of the dispensing end 89. The tank 93 can be connected to a sprayer by an electric pump for use in cleaning the asphalt hopper, asphalt chute (95 in FIG. 2) and other tools. The hydraulic system used to power the screw conveyor, agitator, tack oil pump and jack hammer is controlled by hand valves 97 located at the dispensing end 89.

In operation, the heat transfer oil in the tank 19 is heated by the propane burner 23 which, in turn, heats the asphalt mix in the hopper compartment 15. Heat transfer oil is circulated within the tank 19 by means of conduit 33 and opening 35 and heat transfer oil is circulated within the separate tack oil tank 59 through conduit 63 to warm the tack oil tank. The heat transfer oil does not intermix with the tack oil but is circulated through heat transfer conduits 65 and back through conduit 67 to the heat transfer oil tank 19. At the job site, suitable hydraulic tools are connected to the lines 91 so that repairs can be quickly accomplished. Spray equipment such as wand 77 can be connected to discharge valve 99 for dispensing liquid asphalts or emulsions to seal and tack the dressed cavity. The screw conveyor 37 is then actuated to dispense asphalt mix materials from the hopper compartment 15 through the chute 95 into the cavity as required. The filled cavity can then be compacted with a hydraulic tamper to complete the job.

The present invention is directed to improvements in the hopper compartment 15, heat transfer compartment 19 and the mechanism for transferring heat to the bottom wall 17 of the hopper compartment for maintaining the asphalt repair materials contained therein in a workable state.

Figure 5:
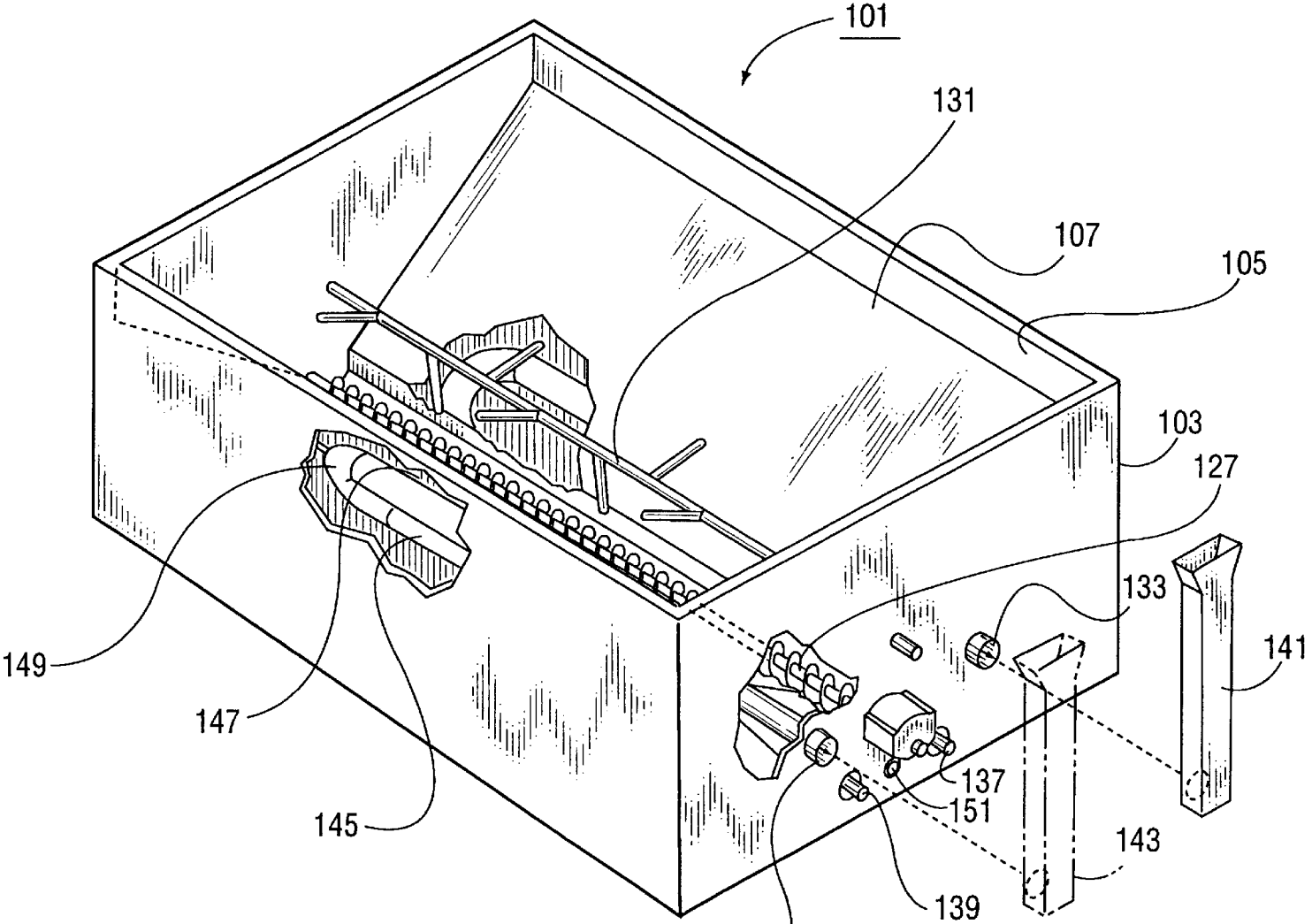
FIG. 5 is a perspective view, partly broken away, of the improved body used with the apparatus of FIG. 1 showing the screw conveyor, paddle shaft and radiant heat source thereof.
Figure 6:
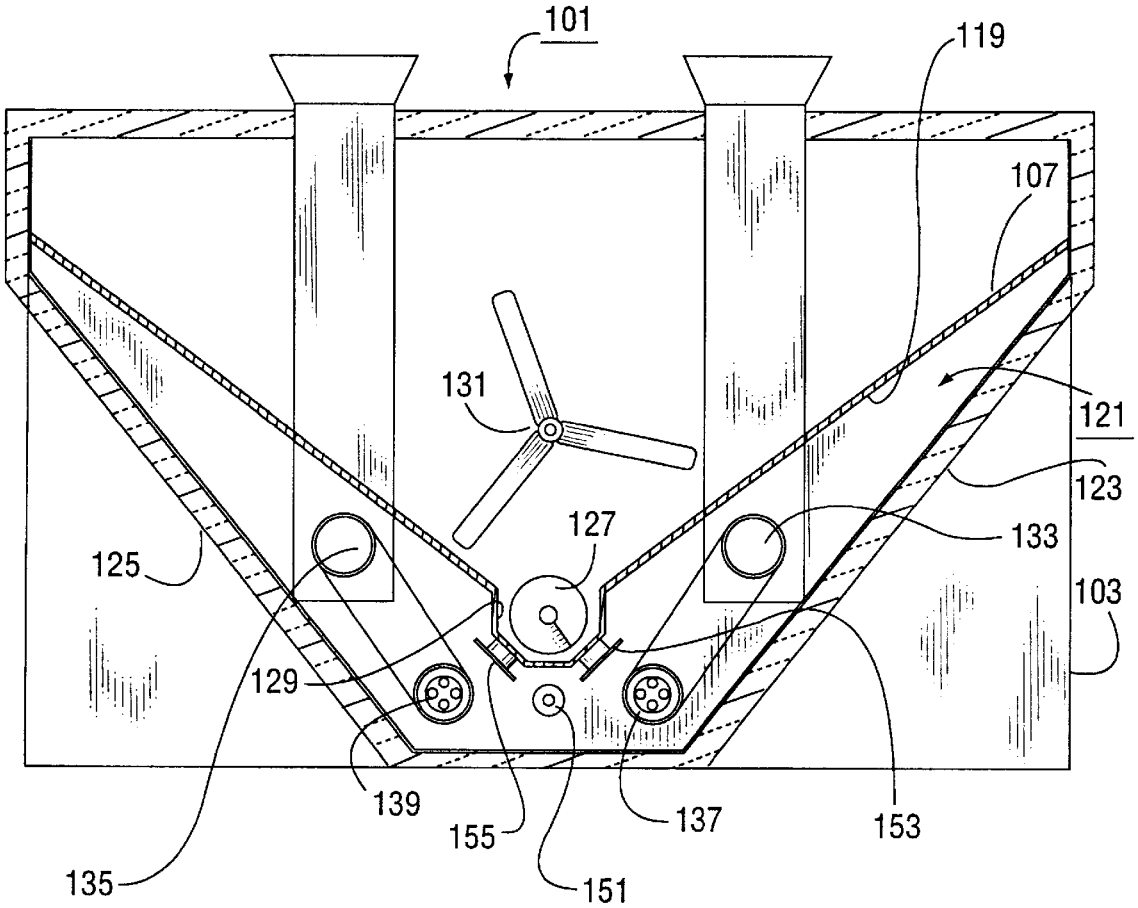
FIG. 6 is an end, partial cross-sectional view of the improved device of FIG. 5.

FIGS. 5 and 6 illustrate the improved device of the invention designated generally as 101. The device includes a body 103 which is adapted to be mounted on a portable base. The body has a hopper compartment 105 (FIG. 5) with a V-shaped bottom wall 107 for transporting asphalt mix materials. As best seen in FIG. 6, the V-shaped bottom wall of the hopper compartment forms an upper, uninsulated common wall 119 of a V-shaped heating chamber 121. The V-shaped heating chamber 121 is thus located below the hopper compartment 115 with the V-shaped bottom wall of the hopper compartment defining an upper extent of the heating chamber 121. The heating chamber also has oppositely extending, insulated bottom wall portions 123, 125, as shown in FIG. 6.

As shown in FIGS. 5 and 6, the body 103 of the portable device is also equipped with a screw conveyor 127 which is mounted in the bottom region 129 of the hopper which forms a trough-like opening extending longitudinally along the bottom wall thereof. As previously described, the screw conveyor 127 is used to dispense asphalt mix materials contained within the hopper.

An agitator means, such as paddle shaft 131 is located above the screw conveyor 127 in the hopper compartment 115 for agitating the hopper materials contained therein.

A dry heat means is associated with the heating chamber 121 for heating the chamber and for transferring heat to the hopper compartment 115 through the hopper bottom wall 117 to maintain the asphalt mix materials contained therein in a workable state. Preferably, the dry heat means comprises a pair of oppositely arranged retort tubes 133, 135 which are located within the heating chamber 121 on either side of the V-shaped bottom wall of the hopper. The retort tubes are each heated by a 150,000 btu retort tube propane burner. The burners are thermostatically controlled and regulated at 10 psi. Commercially available ignition systems utilize a 12 volt DC electronic igniter. The gas burner is preferably provided with a safety shut-off on loss of flame or excessive temperature. The commercially available burner, ignition and safety shut-off system for the retort tubes can be obtained from H. D. Industries, Inc., of Jacksonville, Tex. The commercially available burner has two stages, ignites on 10 ounces of pressure and operates at 10 psi. The retort tubes are used to supply dry, radiant heat to the bottom wall of the hopper compartment.

As shown in FIGS. 5 and 6, each retort tube 133, 135 forms a single pass loop which has a burner 137, 139 installed at one extent thereof and which communicates with an exhaust conduit such as exhaust stacks 141, 143 at an opposite extent thereof (FIG. 5). As best seen in FIG. 5, each retort tube 133, 135 is provided in the shape of an inclined U which is arranged in a plane which is generally parallel to a selected one of the oppositely extending, insulated bottom wall portions (123, 125 in FIG. 6) of the heating chamber 121. Each retort tube 133, 135 thus has a pair of outlets to the exterior of the tank. One of the outlets has the burner mounted therein while the other of the outlets communicates with the exhaust stacks 141, 143 as an exhaust conduit.

Each U-shaped retort tube includes a first leg 145 (FIG. 5) which contains the burner 139 and an oppositely extending second leg 147 which leads to the exhaust stack 143. The two legs 145, 147 are connected by a curved, loop portion 149. As shown in FIG. 6, the heating chamber 121 can also be provided with an electric emersion type heater 151 as described with respect to the prior art apparatus.

As best seen in FIG. 6, the heating chamber 121 further includes a pair of heat deflectors 153, 155 which are mounted in proximity to the screw conveyor 127 of the hopper. Each heat deflector is arranged to extend along a first leg of a respective retort tube to partially shield the region of the screw conveyor from the dry heat source.

The apparatus of the invention can also include a separate liquid asphalt tank mounted on the portable base for transporting and dispensing liquid asphalt type materials used to dress a pothole prior to dispensing the asphalt mix materials from the hopper. The separate liquid asphalt tank could take the form of the tank shown as 59 in FIG. 2 of the drawings. The separate liquid asphalt tank can also take the form of the tank described in issued U.S. Pat. No. 4,944,632, supra, assigned to the assignee of the present invention. That tank is provided with an internal circulation system for maintaining liquid tack oils in an emulsified state.

In the method of the invention, the portable base as previously described is used to transport asphalt mix type materials to a repair site. The V-shaped heating chamber located below the hopper compartment is used to heat the asphalt mix materials. The paddle shaft 131 is utilized to agitate the hopper materials with the screw conveyor 127 being used to dispense materials therefrom. The burners 137, 139 are utilized as a dry heat source associated with the heating chamber for heating the chamber and for transferring heat to the hopper compartment through the hopper bottom wall to maintain the asphalt mix materials in a workable state.

An invention has been provided with several advantages. The device is simpler in design and more economical to manufacture than prior art devices of the same general type. By using a dry, radiant heat source, volatile constituents having asphaltene or other components are not released to the atmosphere, thereby providing a more environmentally compatible operation. By eliminating the use of a liquid heat transfer medium, the hopper compartment can be heated more economically without the need to replenish the heat transfer medium or maintain such medium.

While the invention has been shown in only one of its forms, it is not thus limited but is susceptible to various changes and modifications without departing from the spirit thereof.

What is claimed is:

1. A portable device for transporting asphalt repair materials for use in repairing potholes in asphalt pavements, the device comprising:

a body adapted to be mounted on a portable base for transporting the body to a repair site, the body having a hopper compartment with a V-shaped bottom wall for transporting asphalt mix materials and a generally V-shaped heating chamber located below the hopper compartment, the V-shaped bottom wall of the hopper compartment defining an upper extent of the heating chamber;

a screw conveyor mounted in the bottom of the hopper compartment for dispensing asphalt mix materials therefrom;

a paddle shaft located above the screw conveyor in the hopper compartment for agitating the hopper materials;

a dry heat means associated with the heating chamber for heating the chamber and for transferring heat to the hopper compartment through the hopper bottom wall wherein the dry heat means comprises a pair of oppositely arranged retort tubes located within the heating chamber on either side of the V-shaped bottom wall of the hopper, the retort tubes being heated by a thermostatically controlled gas burner for supplying dry, radiant heat to the bottom wall of the hopper to maintain the asphalt mix materials in a workable state.

2. The device of claim 1, wherein the V-shaped bottom wall of the hopper compartment forms an upper, uninsulated common wall of the heating chamber, the heating chamber having oppositely extending, insulated bottom wall portions.

3. The device of claim 2, wherein each retort tube forms a single pass loop which has a burner installed at one extent thereof and which communicates with an exhaust stack at an opposite extent thereof.

4. The device of claim 3, wherein each retort tube is provided in the shape of an inclined U arranged in a plane which is generally parallel to a selected one of the oppositely extending, insulated bottom wall portions of the heating chamber, each retort tube having a pair of outlets to the exterior of the tank, one of the outlets having the burner mounted therein and the other of the outlets serving as an exhaust conduit.

5. The device of claim 4, wherein each U-shaped retort tube includes a first leg containing the burner and an oppositely extending second leg leading to the exhaust outlet and wherein the heating chamber further includes a pair of heat deflectors mounted therein in proximity to the screw conveyor of the hopper, each heat deflector being arranged to extend along a first leg of a respective retort tube to partially shield the region of the screw conveyor.

6. A portable device for transporting asphalt repair materials for use in repairing potholes in asphalt pavements, the device comprising:

a body adapted to be mounted on a portable base for transporting the body to a repair site, the body having a hopper compartment with a V-shaped bottom wall for transporting asphalt mix materials and a generally V-shaped heating chamber located below the hopper compartment, the V-shaped bottom wall of the hopper compartment defining an upper extent of the heating chamber;

a screw conveyor mounted in the bottom of the hopper compartment for dispensing asphalt mix materials therefrom;

a paddle shaft located above the screw conveyor in the hopper compartment for agitating the hopper materials;

a dry heat means associated with the heating chamber for heating the chamber and for transferring heat to the hopper compartment through the hopper bottom wall to maintain the asphalt mix materials in a workable state;

wherein the dry heat means comprises a pair of oppositely arranged retort tubes located within the heating chamber on either side of the V-shaped bottom wall of the hopper, the retort tubes being heated by a thermostatically controlled gas burner for supplying dry, radiant heat to the bottom wall of the hopper; and wherein each retort tube forms a single pass loop which has a burner installed at one extent thereof and which communicates with an exhaust stack at an opposite extent thereof, each retort tube being provided in the shape of an inclined U arranged in a plane which is generally parallel to a selected one of the oppositely extending, insulated bottom wall portions of the heating chamber, each retort tube having a pair of outlets to the exterior of the tank, one of the outlets having the burner mounted therein and the other of the outlets serving as an exhaust conduit.

7. The device of claim 6, further comprising:

a separate liquid asphalt tank mounted on the portable base for transporting and dispensing liquid asphalt type materials used to dress the pothole prior to dispensing the asphalt mix materials.

8. A method of repairing a pothole in an asphalt pavement, comprising the steps of:

providing a body on a portable base for transporting the body to a repair site, the body being equipped with a hopper compartment with a V-shaped bottom wall for transporting asphalt mix materials and a generally V-shaped heating chamber located below the hopper compartment, the V-shaped bottom wall of the hopper compartment defining an upper extent of the heating chamber;

providing a screw conveyor mounted in the bottom of the hopper compartment for dispensing asphalt mix materials therefrom;

providing a paddle shaft located above the screw conveyor in the hopper compartment for agitating the hopper materials;

utilizing a dry heat means associated with the heating chamber for heating the chamber and for transferring heat to the hopper compartment through the hopper bottom wall to maintain the asphalt mix materials in a workable state; and dispensing asphalt mix materials from the hopper compartment to fill and repair the pothole.

9. The method of claim 8, wherein heat is supplied to the heating chamber by means of a pair of oppositely arranged retort tubes located within the heating chamber on either side of the V-shaped bottom wall of the hopper, the retort tubes being heated by a thermostatically controlled gas burner for supplying dry, radiant heat to the bottom wall of the hopper.

10. The method of claim 9, further comprising the steps of:

providing a separate liquid asphalt tank mounted on the portable base for transporting and dispensing liquid asphalt type materials;

dispensing liquid asphalt material to dress the pothole prior to dispensing the asphalt mix materials.

* * * * *